US007938093B2

(12) United States Patent
Rasmussen

(10) Patent No.: US 7,938,093 B2
(45) Date of Patent: May 10, 2011

(54) TWO PIECE CAST FERROUS CROWN PISTON FOR INTERNAL COMBUSTION ENGINE

(75) Inventor: Robert Rasmussen, Henderson, NV (US)

(73) Assignee: Industrial Parts Depot, Inc., Torrance, CA (US)

( * ) Notice: Subject to any disclaimer, the term of this patent is extended or adjusted under 35 U.S.C. 154(b) by 4 days.

(21) Appl. No.: 11/789,502

(22) Filed: Apr. 25, 2007

(65) Prior Publication Data

US 2008/0066615 A1 Mar. 20, 2008

Related U.S. Application Data

(63) Continuation-in-part of application No. 10/972,824, filed on Oct. 25, 2004, now abandoned.

(51) Int. Cl.
*F02F 3/00* (2006.01)

(52) U.S. Cl. ..... 123/193.6

(58) Field of Classification Search ..... 123/193.6; 92/208, 255

See application file for complete search history.

(56) References Cited

U.S. PATENT DOCUMENTS

| | | | | |
|---|---|---|---|---|
| 2,296,478 | A | | 9/1942 | Morgan |
| 3,363,608 | A | | 1/1968 | Scherenberg et al. |
| 3,532,030 | A | | 10/1970 | Grenville |
| 4,056,044 | A | | 11/1977 | Kamman et al. |
| 4,180,027 | A | | 12/1979 | Taylor |
| 4,413,597 | A | | 11/1983 | Stang et al. |
| 4,502,422 | A | | 3/1985 | Brann |
| 4,986,167 | A | | 1/1991 | Stratton et al. |
| 4,989,559 | A | * | 2/1991 | Fletcher-Jones ..... 123/193.6 |
| 5,081,968 | A | * | 1/1992 | Bruni ..... 123/193.6 |
| 5,144,844 | A | | 9/1992 | Mathiak et al. |
| 5,144,923 | A | | 9/1992 | Leites et al. |
| 5,199,318 | A | | 4/1993 | Hudson |
| 5,299,538 | A | | 4/1994 | Kennedy |
| 5,339,352 | A | | 8/1994 | Armstrong et al. |
| 5,546,896 | A | | 8/1996 | Zaiser |
| 5,913,960 | A | * | 6/1999 | Fletcher-Jones ..... 92/219 |
| 6,155,157 | A | | 12/2000 | Jarrett |
| 6,453,797 | B1 | | 9/2002 | Bauer |
| 6,494,170 | B2 | | 12/2002 | Moloney et al. |
| 6,499,387 | B2 | | 12/2002 | Bedwell |
| 6,526,871 | B1 | | 3/2003 | Zhu et al. |
| 6,557,514 | B1 | | 5/2003 | Gaiser |
| 6,588,320 | B2 | | 7/2003 | Gaiser et al. |
| 6,938,604 | B2 | | 9/2005 | Gabriel et al. |
| 6,957,638 | B2 | | 10/2005 | Scharp |

* cited by examiner

*Primary Examiner* — M. McMahon
(74) *Attorney, Agent, or Firm* — Wegman, Hessler & Vanderburg

(57) ABSTRACT

This invention relates to an articulated two piece piston designed for reciprocable movement within a combustion chamber of an internal combustion engine. The piston has a crown of high-strength ferrous material that is precision cast net to finished dimensions on all inner and outer surfaces to provide a controlled thickness throughout to ensure mechanical and thermal consistency without any additional machining of the crown. The crown is attached to a separate skirt by the use of a wrist pin, wherein the skirt is made of ferrous or non-ferrous materials by casting or other means.

7 Claims, 3 Drawing Sheets

FIG 1

TWO PIECE CAST FERROUS CROWN PISTON FOR INTERNAL COMBUSTION ENGINE

REFERENCE TO RELATED APPLICATION

This application is a Continuation-In-Part of and incorporates by reference U.S. application Ser. No. 10/972,824 entitled "TWO PIECE CAST FERROUS CROWN PISTON FOR INTERNAL COMBUSTION ENGINE" filed Oct. 25, 2004 now abandoned.

BACKGROUND OF THE INVENTION

1. Field of the Invention

This invention relates to a two piece piston which incorporates a high strength cast ferrous crown having a constant wall thickness together with a separate machined piston skirt made of various ferrous and non-ferrous materials; conjoined by the piston/connecting rod wrist pin.

2. Description of Related Art

Internal combustion (IC) engines have been utilized for years in stationary and mobile applications. Examples of the former include pumps, generators, oil field equipment, compressors, and the like, while examples of the latter include heavy tractors, trucks, earthmoving equipment, automobiles, marine propulsion and auxiliary uses and the like.

Recent developments to the numerous types of IC engines in the last fifteen years have demonstrated that in the diesel engine and high power gaseous fueled applications of such engines, substantial thermal efficiencies, increases in power as a ratio of engine displacement, and reductions in emission can be achieved by increasing the combustion pressure and in the case of the diesel engine, the fuel injection pressures.

These increases in mechanical and thermal efficiency have been achieved through increasing intake air pressure by a factor of several magnitudes of atmospheric pressure by the utilization of mechanical and/or turbo supercharging, by increasing diesel fuel injection pressure and with precision mechanical and/or electronic means of controlling the operation and thermal condition of the subject IC engine by the use of electronic engine management systems.

These developments have all resulted in an increase in the temperature of the combustion process in both the diesel and gaseous fuel iterations of the IC engine which has manifested itself in the form of piston top (crown) temperatures that exceed the thermal limits of known materials and applications.

Known methods of cooling such pistons by use of oil jets from beneath and temporary retention and heat rejection by captured oil delivered by such means have failed to solve the problems satisfactorily in most applications.

The makers of IC engines and parts have further sought many avenues of materials and design to solve the dual problems of material strength at elevated temperatures and acceptable material weight.

This concurrent need for thermal strength and acceptable weight is the result of the piston in an IC engine being a moving, in fact, reciprocating part that moves through the piston bore of such engines at high linear speeds in order to translate combustion pressure on the piston through connecting rod into rotational energy at the crankshaft.

In addition, the piston in its cylindrical bore has been traditionally and remains sealed between the combustion part located between the top of the moving piston and the cylinder top or head and the remainder of the engine by a multiplicity of sealing rings that are installed in circumferential groove machined into the outer diameter of the piston itself, each ring being in the form generally of a rectangular cross section that is radially cut to permit its elongation and installation in the groove in the piston.

In the most recent development of IC technology it has further been proven that the closer that the top most of the aforementioned sealing rings can be installed to the top of the piston itself, the less stagnant or residual gasses remaining from the preceding combustion event will be present and the amount of certain undesirable combustion by products including but not limited to oxides of nitrogen and monoxides of carbon will be substantially minimized by the engine in its operation.

This desire to particularly locate the topmost piston ring has by itself posed unique material and design problems that have not been satisfactorily addressed in a cost effective manner by existing designs and iterations of piston technology.

Although there have been numerous methods applied by the makers of engines and pistons to solve these multiple objectives (high strength, thermal stability, ring groove stability, production costs) none have been entirely satisfactory from either a weight or strength standpoint, or alternatively, if such a design and operational balance is approached, it is by methods and designs that are substantially more costly to produce that the prior common aluminum IC piston that has been the standard for over 60 years.

In this search for acceptable dual qualities of thermal strength and acceptable component weight, among the methods used are the following, each with its unsatisfactory characteristics noted:

1. High strength aluminum pistons:

Heat resistant alloys are costly and difficult to forge or cast, will not withstand combustion pressures and temperatures at existing engine power levels, and prematurely fail in service;

2. Cast or forged aluminum or aluminum alloy pistons with cast in place ferrous inserts for ring grooves and piston tops/combustion cavities:

Costly to manufacture and at high temperatures the remaining aluminum eventually erodes or loses necessary thermal strength;

3. One piece cast iron pistons that mimic aluminum designs:

Heavy weight and inconsistent expansion/thermal characteristics limit applications and combustion pressures due to poor weight strength ratio;

4. Two piece pistons with forged and machined ferrous crowns connected to cast/forged and machined aluminum skirts by the use of high strength elongated gudgeon/wrist pins:

Very high cost to manufacture piston crowns;

5. Forged and machined ferrous piston crowns that are joined by mechanical means or friction welding to ferrous or non-ferrous skirts with a common piston/gudgeon pin:

Very costly to manufacture, compromised thermal characteristics and unsatisfactory in long term service;

6. Forged and machined one piece ferrous skeleton piston:

In addition, since these pistons, of whatever design, do wear in service, particularly in comparison to the life of the entire engine where pistons may be replaced five or ten times in a typical engine's installed service life; thus for this reason, a substantial market has developed for pistons utilized both in the initial, typically name brand, production of the engines as well as in the aftermarket repair and rebuilding of the engines.

In consideration of the above, piston manufacturers are constantly developing new technology relative to existing designs in a search for longevity of initially installed pistons as well as those used in the rebuilt/remanufactured processes in order to lengthen the service life of a particular engine block.

Examples of these efforts include the Detroit diesel engine as set forth in U.S. Pat. No. 5,299,538; the Cummings piston as set forth in U.S. Pat. Nos. 5,144,844 and 5,339,352; the Mercedes engine as set forth in U.S. Pat. Nos. 3,363,608 and 4,413,597; and, the Caterpillar piston as set forth in U.S. Pat. No. 4,056,044.

In addition to the above, additional piston designs have been developed by various manufacturers in order to increase the initial and subsequent service life of the engine. An example is the Mack piston as set forth in U.S. Pat. No. 4,180,027.

The purpose of these various engine and piston designs is said to provide increased thermal equalization, mechanical stability, and longer service life. While they may do so, the cost of the tooling and manufacturing processes is significant, and the secondary machining operations are numerous, complicated, and costly; finally not always resulting in acceptable in service life or desired engine performance characteristics.

SUMMARY OF THE INVENTION

The present invention is directed to a two piece piston having a cast ferrous or similar high strength and heat resistant material piston crown of interior dimensions of net values which provides a piston crown having a controlled and constant thickness throughout to ensure mechanical and thermal consistency without additional machining of the interior diameters and other surfaces of the piston crown and this is attached to a separate skirt by the use of the wrist pin, wherein the skirt made of ferrous or non-ferrous materials by casting or other means.

This use in manufacturing and service of a net dimension casting also improves the distribution of heat within such crown. This invention also increases the efficiency of heat transfer to the cooling oil typically present in the piston through cooling jets or reservoirs of oil impinged upon the piston from beneath and contained therein, respectively. This in turn improves the thermal transfer between the piston crown and the cooling system of the engine. In addition, the utilization of a cast net to dimension piston interior reduces the areas of the piston which may be usually subject to high temperature differentials, thus improving the longevity of the piston.

These and other features and advantages of this invention are described in, or are apparent from, the following detailed description of various exemplary embodiments of the systems and methods according to this invention.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
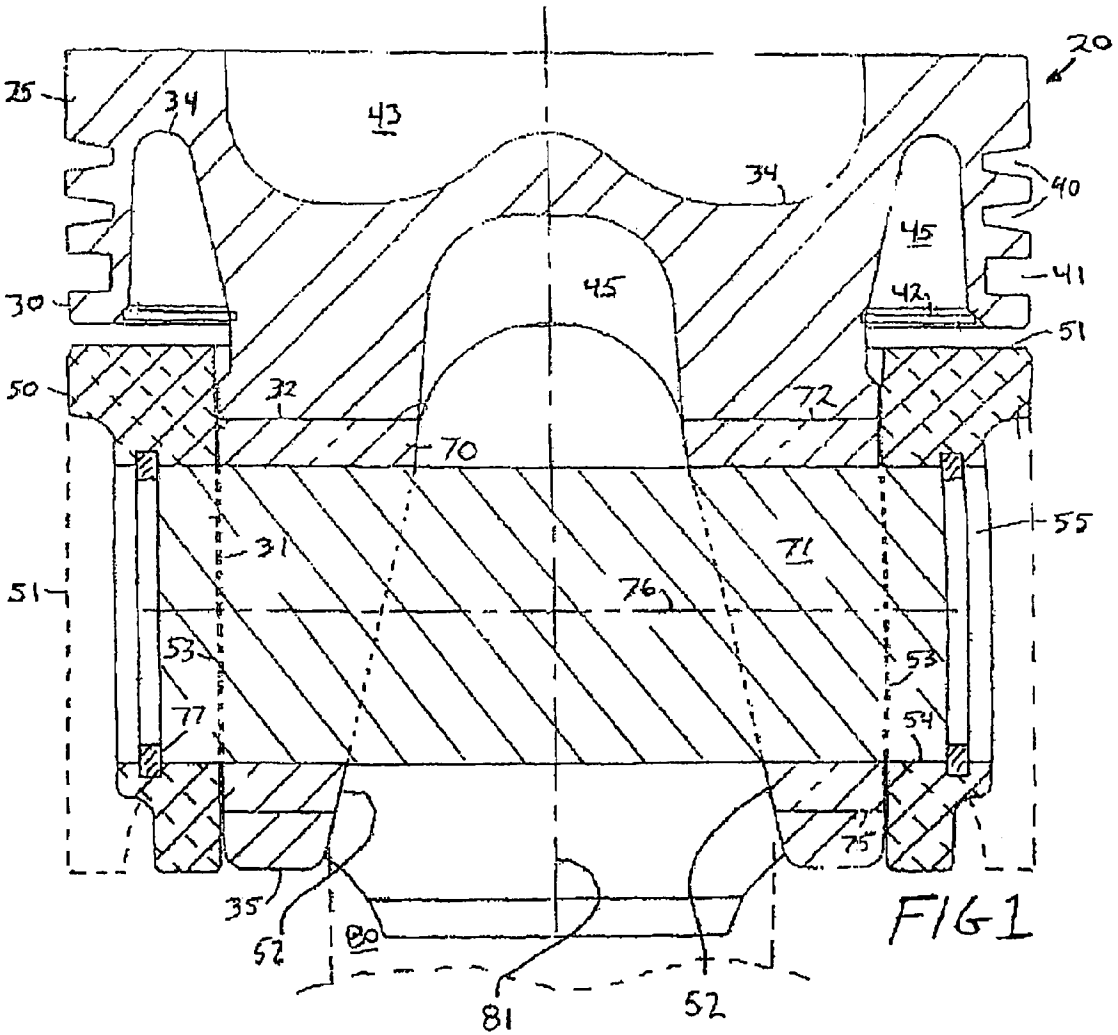
FIG. 1 is a view of a piston.
Figure 2:
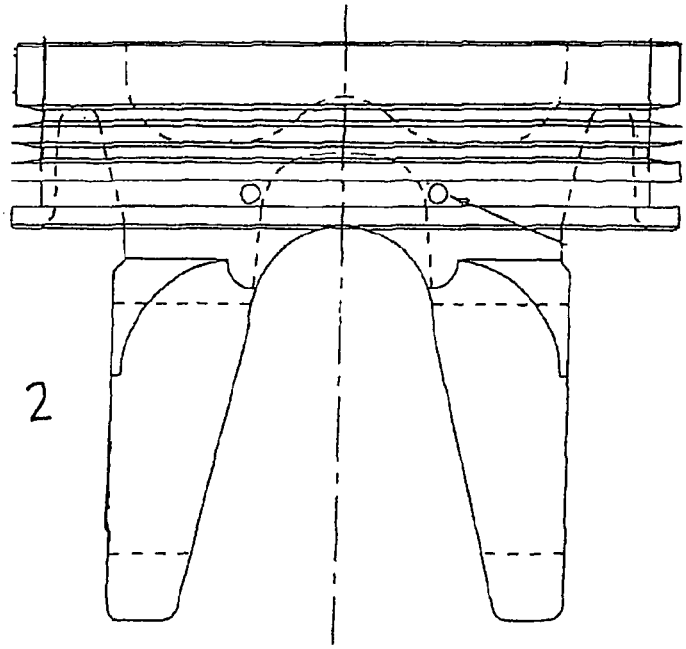
FIG. 2 is a long view of piston crown of FIG. 1.
Figure 3:
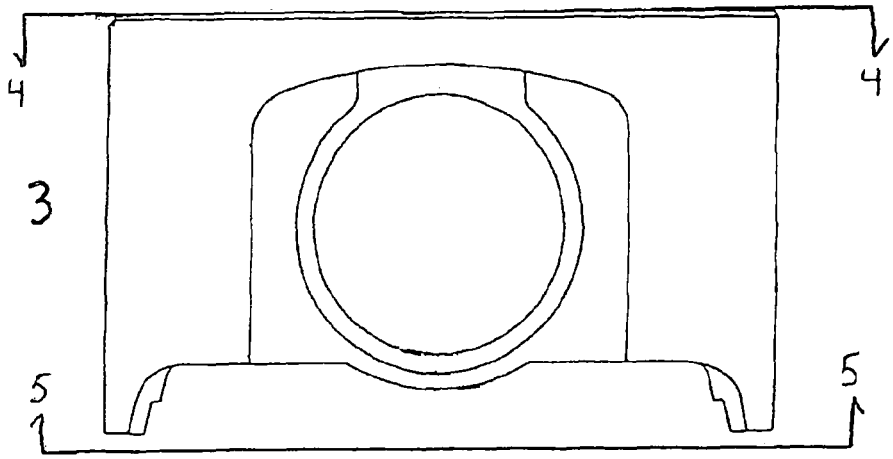
FIG. 3 is a side view of the piston skirt of the piston of FIG. 2.
Figure 4:
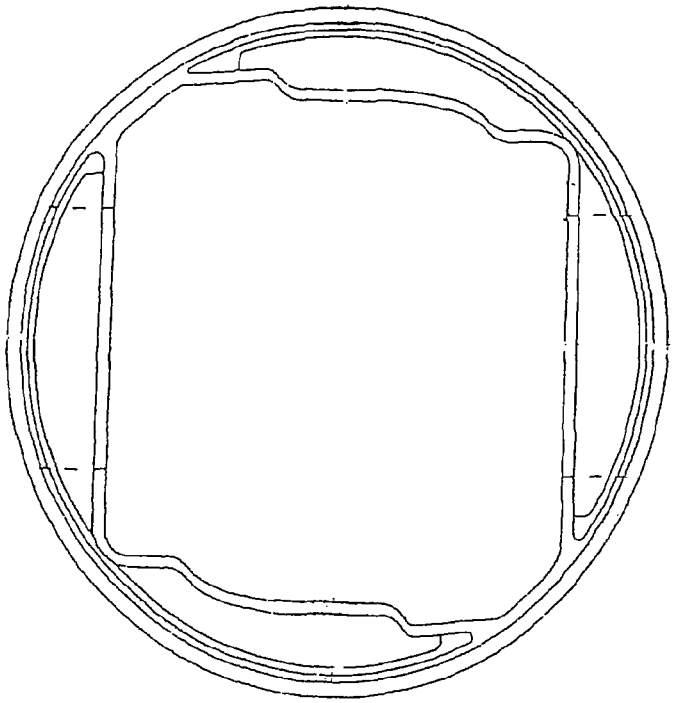
FIG. 4 is a view of the top of the piston skirt taken generally from lines 4-4 in FIG. 3
Figure 5:
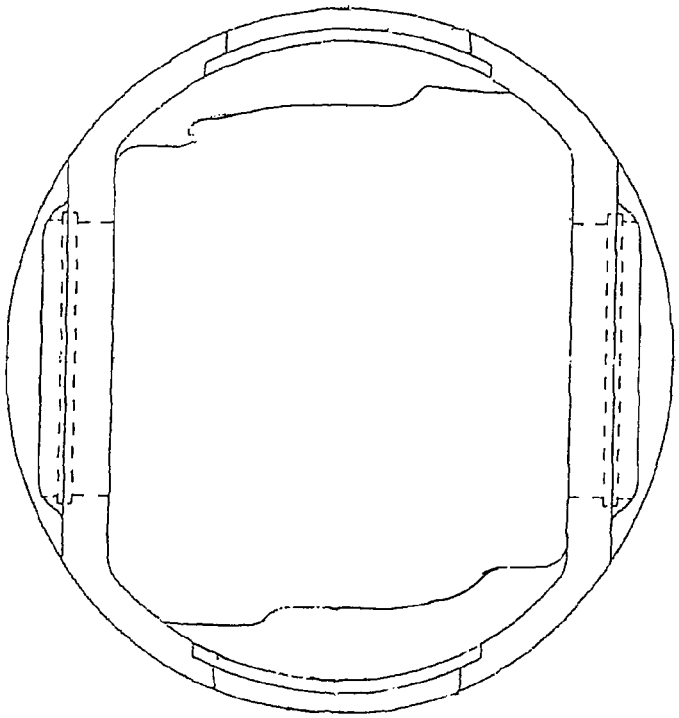
FIG. 5 is a view of the bottom of the piston skirt of FIG. 3 taken generally from lines 5-5 therein.

Referring now to FIGS. 1-5, the invention relates to a piston 20 for use in an internal combustion engine together with an investment cast method of manufacturing the piston. An example would be to utilize the piston 20 in an original manufacture of an after-market repair or remanufacture of a Detroit Diesel, Cummins, or Caterpillar diesel. The piston 20 itself in the preferred embodiment is an articulated two piece piston having a crown 25 and a piston skirt 51. The crown 25 is the main combustion chamber interactive part of the piston 20. This crown 25 is investment or other permanent or non-permanent mold/die precision cast. This provides for the creation of both internal and external surfaces of a complex part with dimensional stability in a single initial manufacturing step. The crown 25 is thus of substantially lighter weight than a typical forged or sand cast ferrous piston and amenable to a more complex design. This reduces the complexity and cost of the final secondary finish manufacturing. Further, the surface finish of the crown 25 is relatively smooth and free of surface defects. The crown 25 can thus be investment or other permanent or non-permanent mold/die precision cast with minimal finish manufacturing tolerances (i.e., the crown is cast to zero net size finished or only minimally oversized—only that necessary to allow secondary finishing within a commercially acceptable range). This enables one to materially and substantially reduce the complexity of manufacturing of the piston 20 for internal combustion engines by casting them to dimensionally net shape and size and by therefore eliminating machining operations necessary to achieve constant and correct cross sectional dimensions of the crown and attendant skirt.

It is desirable to increase the service life of the piston 20 by manufacturing it from wear resistant ferrous materials that further remain dimensionally stable under conditions of high heat and pressure. In addition to the known and proven ferrous materials, and while the crown 25 shown is of steel alloy, it is possible to make the piston out of other metals that are subject to or adaptable to net dimensional casting methods which presently include investment casting, lost wax casting, lost foam casting, metallic and non-metallic permanent mold casting, and precision non-permanent mold casting.

This design and invention combining the use of net dimensional casting processes increases the adaptability of the piston to numerous applications with minimal additional tooling and/or material considerations. It is also noted that the weight reduction of the precision net dimensional cast piston is particularly important wherein the reduction of reciprocating mass increases both the efficiency and the service life longevity between repair and rebuilding operations thereof.

In addition, the balance or weight differential as manufactured between multiple pistons is reliable and predictable for economy in maintenance of inventory, replacement purposes, and the process of dynamically and statically balancing the reciprocating and rotating masses of an engine.

This secondary operation in the embodiment disclosed includes finishing the outer surface 30 of the crown 25 (in consideration of the diameter of the cylinder in the engine), the outer edge 31 of the rod connection flange 35 (in consideration of the inner dimension of the piston skirt 51), the bearing seat 32 (to match the outer diameter of the sleeve bearing 70), and the dimension of the top surface of the crown 25 (to match the bearing seat 32 to the head of the engine to provide the desired combustion ratio at top dead center piston location). This further reduces the cost of the piston 20 significantly over alternative processes such as forging or conventional casting and subsequent machining.

Due to the use of a precision net to dimension casting, the crown 25 can be produced of a ferrous material with a thinner cross section, a more intricate shape, and with a higher initial tolerance than otherwise possible. Further, features as set forth are otherwise difficult or costly to machine can be included but are not limited to a cast in place dam of planar section at or near the inner diameter of the crown 25 for cooling oil retention, a separate metal plate so forming an oil retention dam fixed in similar place by (i) a circular spring ring, (ii) friction welding, (iii) interference fit, (iv) resistance or fill welding, (v) adhesives, and (vi) rotational locking and/or similar means.

The outer surface 30 of the crown 25 has ring grooves 40 designed to cooperate with piston rings and the inner wall of the cylinder liner 100 to define the lower extent of the combustion chamber. An oil groove 41 located below the rings on the upper surface 20 of the crown 25 reduces friction by providing for a lubricant flow at the critical location in the engine.

Due to the use of a net to dimension cast piston, the process finishing the outer surface 30 is significantly reduced from alternative manufacturing processes (such as the previously described forging). Typically, only a minor secondary operation is necessary in order to provide the finish dimensions for the outer surface 30 of the crown 25 due to the accuracy of the casting process, and then primarily to provide dimensional stability for the outer surface 30, the outer edge 31 of the bearing seat 32 and the top surface 20 of the crown 25. This equalizes any given piston to another so as to provide a more efficient and balanced engine and one where the uppermost ring groove is immediately adjacent to the top of the crown 25.

Further, the use of a net dimensional ferrous casting, the thickness of the crown 25 between the outer surface 30 and the lower confines of the swirl chamber 43 on top of the crown 25 and the inner surfaces 36 on the underside 45 of the crown 25 is of a predictable and substantially constant thickness throughout as initially cast. This constant and predictable thickness allows for the efficient transfer of heat and reduction of heat distribution differences within the crown 25. This is in addition to the reduction of weight and reliability of balance due to the accuracy of initial casting of the piston 20.

Further, the auxiliary cooling oil, which is typically sprayed upward from a fixed location beneath the low travel extent of the piston 20, can penetrate further and more evenly within the crown 25 to provide for a more efficient and even heat removal from the piston rings 40 and the swirl chamber 43 at the top of the piston 20 by such cooling oil.

The outer edge 31 of the rod connection flange 35 of the crown 25 locates the piston skirt 51 relative to the crown 25. The outer edge 31 itself cooperates with the later described piston skirt 51 to provide angular stability to the crown 25 in respect to the cylinder 100. This in turn evens out the wear about the circumference of the crown 25, thus to reduce any differential wear about the circumference of the piston 20.

This even distribution of wear by this edge 31 is especially true for forces perpendicular to the longitudinal axis of the wrist pin 71.

The seat 32 of the crown 25 is designed to retain the piston rod pin in a location relative to the piston (via sleeve bearing 70 in the embodiment shown). This serves as the main mechanical interconnection between the piston rod 80 and the piston 20. The seat 32 also cooperates with the wrist pin 71, the piston skirt 51 through the wrist pin 71 to provide angular stability of the crown 25 with respect to the cylinder 100. This evens out any differential wear about the circumference of the piston 20. This evening out is especially true for cocking forces about the longitudinal axis of the wrist pin 71 in both those applications where pin thrust offset is used as in engines and otherwise.

As this seat is a circular hole extending straight through the rod connection flanges 35 of the crown 25, it is amenable to a simple finishing operation due to the accuracy of the initial casting process.

A sleeve bearing 70 is inserted through the rod connection flange 35 in the crown 25 to the wrist pin 71 and thus the connecting rod 80. The use of an independent sleeve bearing 70 allows for the optimization of materials. This also allows the sleeve bearing 70 to be of a non-ferrous metal alloy or other material suitable to a moving, high force rotary interconnection while also allowing the crown 25 to be of a different material (a ferrous or ferrous alloy disclosed).

The use of a separate sleeve bearing 70 also allows for the repair of this high stress area by the replacement of a relatively simple part instead of the entire piston, thus increasing the service life of the remainder of the piston 20.

The constant surface between the piston rod 80 and the piston 20 is designed such that this surface area between these two is greater in the direction of significant power transfer than the direction of return movement. For this reason, the sleeve bearing 70 has a contact surface area 72 on the crown 25 side of the piston 20 significantly greater than the return surface area 75. As a result of this relationship, the crown 25 has sufficient contact area to develop the power inherent in the engine incorporating same. If desired, for example to increase the tear off resistance, the contact surface area 75 can be enlarged.

It is preferred that the sleeve bearing 70 allows the flow of pressurized oil between a passage 81 in the piston rod 80 to the oil groove 41 to lubricate this critical location, a plate or dam 42 closing the bottom of the galley 45 of the crown 25 provides a reservoir for this cooling oil in the various forms noted above and herein.

The cooling oil dam or retention plate 42 is held in place proximally at the lower edge of the crown 25 by the application of a snap ring or circle ring set in a groove or by the application of the mechanical bending or folding of a segmented or non segmented extension of the crown 25 material generally parallel to the axis of the piston rod in either the cold or warm state. In one embodiment, the cooling oil dam or retention plate 42 is held in place proximally at the lower edge of the crown 25 by the application of an interference fit between the inner and outer dimensions of said plate dam and the piston body. In another embodiment, the cooling oil dam or retention plate 42 is held in place proximally at the lower edge of the crown 25 by fixing the same in the precision casting process by casting in place. In another embodiment, the cooling oil dam or retention plate 42 is held in place proximally at the lower edge of the crown 25 by the incorporation of extending tabs on the plate that are inserted in generally segmented apertures in the lower surface of the crown 25 and rotated into a locking mode.

The piston skirt 51 completes the piston 20. Due to the dimensional stability and complexity of its associated crown 25, this skirt 51 can be of relatively simple construction. The particular piston skirt disclosed has a vertical outside surface, a center opening 52, and a lock ring access 55. The outside surface of the piston skirt 51 cooperates with the inner wall of the cylinder 100 of the engine to support the crown 25 against any tipping or angular displacement in respect to the longitudinal axis of the cylinder 100. As previously discussed, this support is provided through the outer edge 31 and the seat 32 of the crown 25.

To efficiently provide the support for the piston crown 25, the center opening 52 of the piston skirt 51 has two opposed flat support surfaces 53 and pin seat 54. These together cooperate with the connecting rod flange 35 as previously set forth to support the crown 25 against angular movement in a side wards direction (angular cocking re: the longitudinal axis 76 of the wrist pin 71).

Insofar as there are no known forces acting axially or laterally on the piston 20 perpendicular to the axis of the piston pin below the part of the crown 25 that supports the sealing rings, all those parts of the piston usually comprising the skirt thereof regardless of material, geometry, or construction have been eliminated.

The lock ring access 55 allows for physical access to the lock rings 77 which retain the wrist pin 71 in its designed position in respect to the piston 20. This lock ring access 55 generally is a straight cut across the inner surface 36 of the piston skirt 51. This allows for efficient access to the lock ring 77. In addition, a lock ring access 55 can allow for a use of original wrist pins 71 should that be desired (if necessary by varying the location of the lock ring groove). The straight flat surfaces 53 are amenable to being formed in a single manufacturing step.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. An articulated two piece piston designed for reciprocating movement within a combustion chamber of an internal combustion engine, said piston comprising a crown of high-strength ferrous material having an outer surface, a rod connection bearing seat, a top surface, and a rod connection flange being precision cast net to finished dimensions on all inner and outer surfaces to provide a controlled thickness throughout to ensure mechanical and thermal consistency with only secondary finishing of the outer cylindrical surface of the crown, the outer edge of the rod connection flange, the rod connection bearing seat, and the top surface of the crown, the crown being attached to a separate skirt by the use of a wrist pin, wherein the skirt is made of ferrous or non-ferrous materials by casting or other means.

2. The piston of claim 1 wherein the crown has a bottom lower cylindrical surface located above the piston rod connections that is cast with a casting process in a manner to leave no remaining material in any form, the substantial guidance of the crown in the cylinder being accomplished by the separate skirt.

3. The piston of claim 1 wherein the piston has a cooling oil dam or retention plate that is made of a separate metal or thermally resistant non metallic material, or combination thereof and which is held in place proximally at the lower edge of the crown by the application of a snap ring or circle.

4. The piston of claim 1 wherein the piston has a cooling oil dam or retention plate that is made of a separate metal plate or thermally resistant non metallic plate, and is held in place proximally at the lower edge of the crown by the application of an interference fit between the inner and outer dimensions of said plate dam and the piston body.

5. The piston of claim 1 wherein the piston has a cooling oil dam or retention plate that is made of a separate metal or thermally resistant non metallic plate, and which is held in place proximally at the lower edge of the crown by fixing the same in the precision casting process by casting in place.

6. The piston of claim 1 wherein the piston has a cooling oil dam or retention plate that is made of a separate metal or thermally resistant non metallic plate and which is held in place proximally at the lower edge of the crown by the incorporation of extending tabs on said plate that are inserted in generally segmented apertures in the lower surface of the piston crown and rotated into a locking mode.

7. The piston of claim 1 characterized in that said piston has its uppermost or top compression ring groove located proximally to the top of the crown so that the dimension between the top of said sealing ring and the top of the piston is no greater than one to one and one half times the vertical dimension of the cross section of the sealing ring.

* * * * *